United States Patent [19]

Staudinger

[11] 4,298,355

[45] Nov. 3, 1981

[54] METHOD FOR THE GASIFICATION OF COAL

[75] Inventor: Gernot Staudinger, Graz, Austria

[73] Assignee: Voest-Alpine AG, Vienna, Austria

[21] Appl. No.: 81,083

[22] Filed: Oct. 1, 1979

[30] Foreign Application Priority Data

Dec. 29, 1978 [AT] Austria ..... 9346/78
May 23, 1979 [DE] Fed. Rep. of Germany ..... 2920922

[51] Int. Cl.[3] ..... C10J 3/16

[52] U.S. Cl. ..... 48/206; 48/203; 48/DIG. 2; 252/373

[58] Field of Search ..... 48/203, 206, DIG. 2; 252/373

[56] References Cited

U.S. PATENT DOCUMENTS 538,908 5/1895 Gobbe ..... 48/206
2,677,603 5/1954 Van Loon ..... 48/DIG. 2
2,971,830 2/1961 Kawai et al. ..... 48/206
3,018,174 1/1962 Steever ..... 48/206
3,454,383 7/1969 Pirsh et al. ..... 48/203
4,073,627 2/1978 Anderson ..... 48/DIG. 2

FOREIGN PATENT DOCUMENTS 661148 11/1951 United Kingdom ..... 48/206

*Primary Examiner*—Peter F. Kratz
*Attorney, Agent, or Firm*—Wenderoth, Lind & Ponack

[57] ABSTRACT

A pressure container forms a shaft gasifier for receiving coarse coal in the form of a coal bed. A burner extends through the pressure container into a chamber therein and produces at least one primary gas jet directed against the coal bed, thereby gasifying the coal and generating a product gas and forming liquid slag. The liquid slag collects in a slag bath tank having an overflow weir over which the collected slag flows and falls freely toward a cooling water bath beneath the chamber. A water jet nozzle directs at least one water jet against the liquid slag as it falls freely between the weir and the cooling water bath. This atomizes the liquid slag, thereby cooling the slag and generating steam. At least a part of the steam is supplied as process steam to the coarse coal.

11 Claims, 4 Drawing Figures

METHOD FOR THE GASIFICATION OF COAL

BACKGROUND OF THE INVENTION

The present invention relates to a method and an apparatus for the gasification of coal with oxygen or oxygen-containing gas and water vapor and also if necessary $CO_2$, and more particularly to such a method and an apparatus in which powdered coal is gasified in at least one burner, e.g. a cyclone burner, with oxygen or oxygen-containing gas and steam, and also if required added $CO_2$, and the primary gas thereby produced is passed upwardly, preferably in a countercurrent flow and under pressure through coarser coal contained in a shaft gasifier, e.g. a bed of lumps of coal having upper and lower free surfaces, thereby producing product gas and forming liquid slag.

In the present connection, coal is to be taken as meaning the various fuels which contain free carbon, such as anthracite, bituminous coals, brown coal, soot, briquettes, for example. Liquid or gaseous fuels may also be used instead of the fine or powdered fraction. A product gas containing carbon monoxide and hydrogen is produced by the gasification operation. Depending on its composition in each case, a gas of this type may serve as a fuel gas for use in fuel cells or for synthesizing ammonia, methanol, hydrocarbons, phosgene and oxo-alcohols, for example.

With autothermal gasification, on which the present invention is based, there is a combination of the gasification of coarser coal, preferably lumps of coal under increased pressure, preferably in the solid bed in a countercurrent direction, with the gasification of coal dust under increased pressure in a direct current. Measures are taken to ensure that the operation takes place in a temperature range above the ash point and that the slag is drawn off from a shaft gasifier which has no grid in the liquid state. The coarser coal, which is preferably present as a bed of lumps of coal, thus assumes the function of a cooling and filtering unit for the hot primary gas supplied into the lower part of the shaft gasifier. The process heat requirement is met by the partial combustion of the coal dust with oxygen.

There are three known principle processes for the autothermal gasification of coal:

1. Fluidized current gasification using finely ground powdered coal and producing a gas having a high temperature and a low proportion of methane;
2. Fluidized bed gasification using coal of medium grain size and obtaining medium gas temperatures; and
3. Shaft gasification using lumps of coal and producing a gas of lower temperature and, unless coke is used, a high proportion of methane.

As a result of the poor heat economy of fluidized dust gasification and the sensitivity of a shaft gasifier relative to fine coal, various combinations of such methods have already been proposed. For example, a method of gasifying coal is known from German DE-PS No. 4 58 879 in which the coal is separated into lumps and dust by sieving. The lumps are supplied to a shaft gasifier, while the coal dust is gasified in a burner, and the primary gas thereby produced is conducted into the shaft gasifier for drying and gasifying the lumps of coal. The liquid slag collects on an inclined base of the shaft gasifier in front of a lower free sloping surface of a bed of the lumps of coal and may be discharged therefrom via a slag outlet. The process may be controlled in a manner known per se by the injection of water vapor. In such process, however, discharging of the slag creates a problem, especially if the process is carried out under pressure. Such method is also uneconomical, because external heat is required for supplying the water vapor.

Improving the heat balance of a gasification method is known per se from German DE-PS No. 2 88 588, by quenching slag discharging at a lower part of a shaft gasifier inside the shaft gasifier, and by granulating the slag in a water bath. In this connection, the liquid slag is first collected in a tank and passed therefrom into the water bath disposed beneath the shaft gasifier. Steam produced when the slag enters the water bath is compressd via a bypass line into the upper part of the shaft gasifier above the slag fusing zone. This is to prevent the steam from reachng the lower part of the shaft gasifier. In this method inadequate use only of the heat content of the liquid slag is possible since the steam produced is not satisfactorily used as process steam.

A slag bath generator is known from Chem. Ing. Technik, 1956, No. 1, pages 25 to 30, in which pulverized fuel and a gasification agent are injected through separate nozzles into a shaft gasifier obliquely downwardly and approximately tangentially at the level of a slag overspill or overflow located at the base of the shaft gasifier. The overflowing slag reaches a water bed arranged beneath the base of the shaft gasifier and is therein granulated. Steam supplied for the gasification operation must be produced separately.

According to German DE-PS No. 10 42 817, in which primary gas supplied by two lateral dust gasifiers is passed through a bed of coal or coke in a shaft gasifier, the coal dust must be extensively reacted with oxygen before it meets the bed, since otherwise the bed would clog. In this method, the ash may be drawn off in the liquid state or the dry state.

Drawing off liquid slag from shaft gasifiers which are under pressure requires complicated equipment. This means that none of the previously mentioned methods are suitable for gasification under pressure. Also, with the known methods, the considerable content of sensible end latent heat of the liquid slag is partially or completely lost.

A method of producing fuel gas mixtures from fine-grained fuels is known from German DE-PS No. 9 08 516, wherein some of the coal is burnt in burners, preferably constructed as cyclone burners, with oxygen and steam as gasification agents, and the primary gas thereby produced passes through a fluidized bed consisting of the remaining coal, thus resulting in chemical reactions taking place with the coal and in cooling of the primary gas. This method combines the relatively high space-time yields of a direct current method in the first stage with the efficient utilization of heat of a countercurrent method in the second stage. However, such method may be used in practice only if the burners produce a dry ash, since otherwise the fluidized bed would coalesce.

SUMMARY OF THE INVENTION

Accordingly, the object of the present invention is to provide a method and an apparatus for the gasification of coal which may be carried out reliably and with greater economy, more particularly with a better utilization of the heat of the liquid slag and with little pollution.

According to the present invention, this object is achieved by collecting the liquid slag produced in the shaft gassifier in a slag bath and allowing such liquid slag to flow out via an overspill weir into a cooling water bath provided in the shaft gasifier, by atomizing the liquid slag as it is freely falling between the weir and the cooling water bath by means of one or more jets of water, thereby cooling the slag and producing steam, and by supplying at least some of such steam to the coarser coal, preferably to a free lower surface of the bed of coal, as process steam.

In this way efficient use is made of the considerable heat of the liquid slag, and the steam thereby produced can be mixed directly with $CO_2$—containing primary gas supplied from the burners before it enters the coarser coal, preferably the free lower surface of the bed of coal. In the case of coals having an ash content of more than two to ten percent, absolutely no additional steam is required in each case according to the desired composition of the gas. If the ash content of the coal is 20% or more, the steam generation during the process according to the invention is so great that it may be no longer economical to use all the steam as process steam, and it may be desirable to tap off some of the flow of steam and to use it elsewhere, e.g. for drying the coal or for producing mechanical or electrical power.

The cooling water inherent in the overall coal handling operation, the condensation water which occurs in a subsequent product gas purification operation, and also other polluted waste water which occurs in the preceding and subsequent processes, can be used as the jets of water for atomizing the slag. As a result, the process according to the invention is environmentally very advantageous, since no waste process water needs to be discharged and since other polluted waste water may even be consumed.

It has proved to be advantageous for an efficient granulation and steam generation operation to maintain the total mass flow of the jets of water equal to two to ten times as great as the mass flow of the discharging slag. For this purpose, flow velocities of between twenty and 100 m/sec. are advantageous for the jets of water. If the mass flows and/or the flow velocities of the water jets can be regulated, the intensity of granulation can be controlled.

In an advantageus development of the invention at least one primary gas jet from the burners is directed onto the free surface of the slag bath. In this way even coal which is floating in the slag bath can be completely gasified, and a relatively high temperature and therefore fluidity of the slag bath can be achieved.

If, in addition, the primary gas jet is directed over the weir in a direction countercurrent to the liquid slag, the weir may be easily manufactured free of blockages caused by floating pieces of coal or solidified slag.

The jet of primary gas is advantageously directed and arranged so close to the spot where the water jets impinge on the discharging slag that the stream produced when the slag is atomized is carried along with the jet of primary gas in the direction of the coarser coal, preferably in the direction of the free lower surface of the bed of coal. In this way the steam produced when the slag is atomized can be supplied efficiently to the coal bed.

Drawing off the mixture of cooling water and granulated slag produced in the cooling water bath from the cooling water bath, filtering off the granulated slag and recirculating or returning the thereby purified cooling water, if necessary with the addition of make up water, as the jets of water, ensures that no polluting waste water is produced by the gasification process according to the invention. After removal of the HCN by stripping with air, thus leaving residual pollutants of $H_2S$ and $CS_2$, that wash water used for cleaning the product gas of the invention may be used as the additional or make up water. The formation of complex cyanides from the absorption of HCN from the product gas in the cooling water and the subsequent reaction of this HCN with the slag is avoided by a relatively high supply of oxygen in the primary gas and the net flow of steam from the water bed in the direction of the overspill weir and in the direction of the lower free surface of the coal bed.

Before the granular slag is filtered off from the mixture of cooling water and granular slag, the pressure on such mixture can advantageously be reduced still further, and the steam thereby produced may be utilized.

The invention is also directed toward an apparatus for implementing the above described method. The apparatus consists of a pressure container which includes the shaft gasifier for receiving the coarser coal, preferably the bed of lumps of coal, and at least one burner for producing primary gas jets directed onto the coarser coal, preferably the lower free sloping surface of the bed. A chamber is in front of the coarser coal, preferably in front of the lower free surface of the bed. Into the chamber is directed at least one burner producing a jet of primary gas directed toward the coarser coal, preferably the lower free surface of the bed. This chamber is limited downwardly by a slag bath tank having an overspill weir. A cooling water bath is arranged in the pressure container below the chamber. At least one water jet nozzle is arranged opposite the weir.

The lower free surface of the bed therefore directly adjoins the chamber into which opens the burner producing the primary gas jet. The intensive mixing of the water vapor produced when the slag is atomized with the primary gas may take place in this chamber.

If the bottom of the chamber is at least partially limited by the free surface of the slag bath, the liquid slag may discharge from the slag bath over the weir without interruption.

If at least one burner producing a jet of primary gas is directed onto the surface of the slag bath, the overspill weir cannot become blocked.

According to an advantageous development of the invention, the burners and water jet nozzles are arranged directly above or directly below the overspill weir on a steam flow opening between the cooling water bath and the chamber. In this way the steam produced when the liquid slag is atomized is effectively carried along by the primary gas jet of the burner in the direction of the free lower surface of the bed of coal.

It is advantageous to place the bed of coal in a container formed by coolant lines, since this reduces the heat stress of the pressure container forming the shaft gasifier.

The free lower surface of the bed of coal, which is required for the invention, is in the form of a bank which is necessarily formed in a simple manner if the container forms the upper limitation of the chamber and has an inwardly directed projection.

As the primary gas jets are directed onto the free lower surface of the bed of coal, an efficient gasification takes place thereat, despite the filtering off of droplets of slag from the primary gas flow. This is further assisted if at least one stirrer device, e.g. a water-cooled screw conveyor, extends into the container to displace the lumps of coal in the direction of the lower free surface of the bed of coal, since such free surface is then kept in motion and is constantly renewed.

The discharge of polluted waste water is avoided in the device according to the invention by providing a granular slag filter connected after the cooling water bath and having a cooling water outlet connected with the water jet nozzle, if necessary with a pressure release vessel between the cooling water bath and the granular slag filter.

BRIEF DESCRIPTON OF THE DRAWINGS

Additional objects, features, advantages and possibilities for the use of the present invention will be apparent from the following description of an exemplary embodiment, with reference to the attached drawings, wherein.

DETAILED DESCRIPTION OF THE INVENTION

Figure 1:
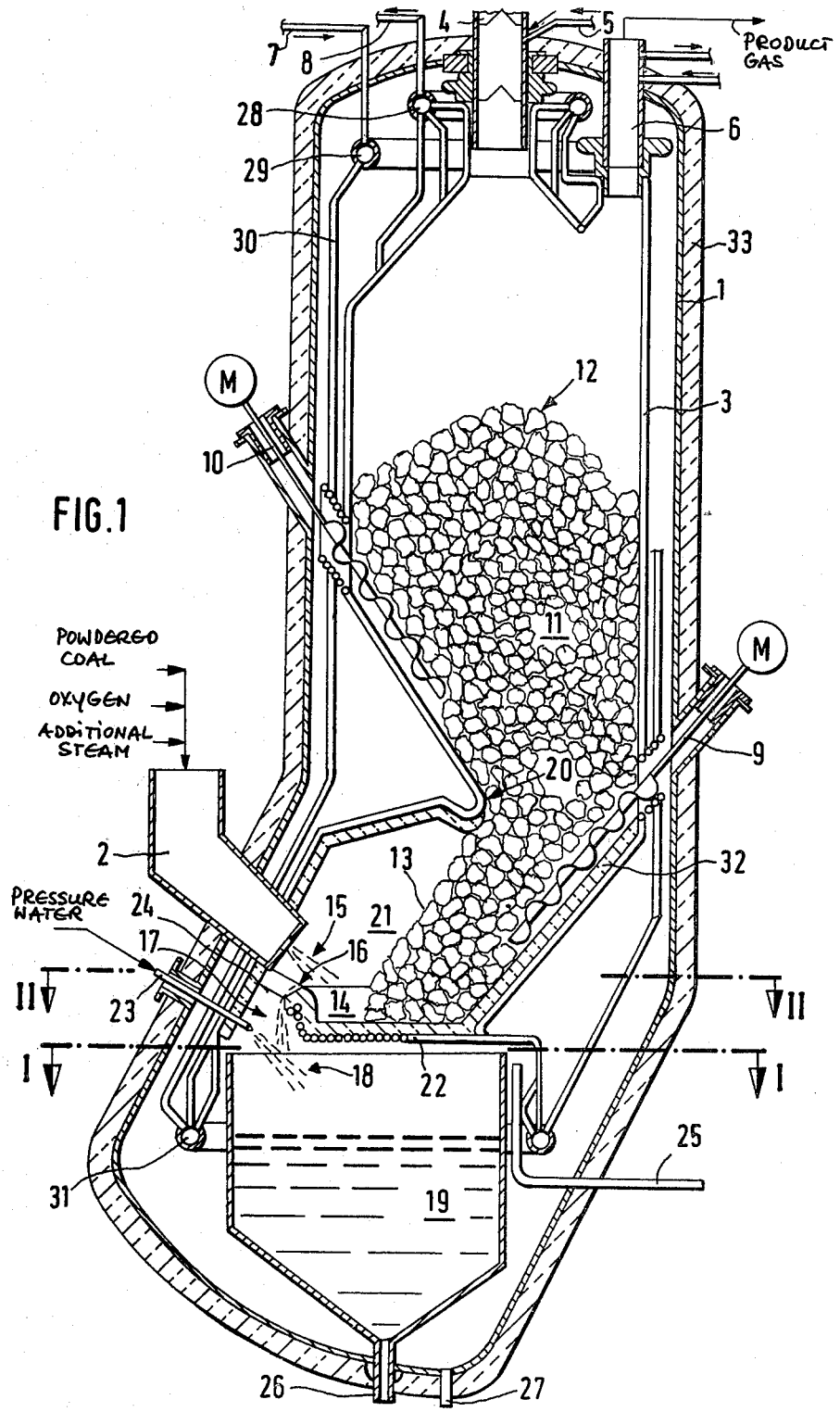
FIG. 1 is a schematic vertical section through a gasificaton apparatus according to the invention.
Figure 2:
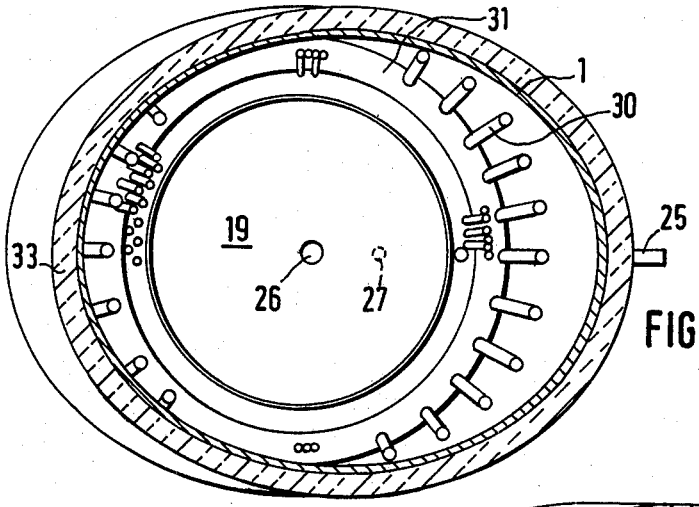
FIG. 2 is a horizontal section along the line I—I of FIG. 1.

A shaft gasifier is formed by a pressure container 1 having a outer layer of insulation 33. The pressure container 1 has an upper vertical section and a laterally bent or inclined lower section.

Lumps of coal are fed into the upper section of the pressure container 1 via a charging valve 4 which is purged after each cycle with an inert gas, e.g. steam, through a line 5.

The lump coal is received within a cooling container 3 supported within the pressure container 1 and formed by cooling water lines, and the lump coal forms therein a coal bed 11 having a free upper surface 12. The cooling water lines forming the cooling container 3 are supplied with cooling fluid via cooling waer supply line 7, an upper ring distributor 29, down pipes 30, which are disposed in the clearance between the cooling container 3 and the pressure container 1, and lower ring distributor 31. The cooling fluid passes upwardly from lower ring distributor 31, through the cooling water lines forming the cooling container 3 to an upper header 28 and is then drawn off via a cooling water discharge line 8.

Figure 3:
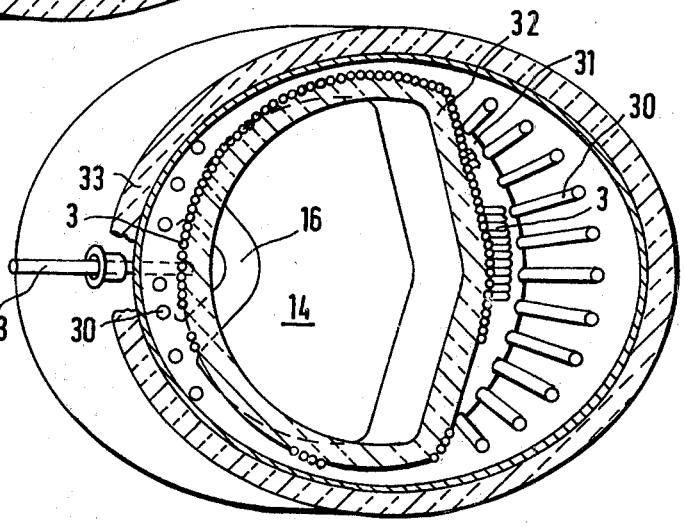
FIG. 3 is a horizontal section along the line II—II of FIG. 1.

The cooling container 3 has an inwardly directed projection 20 in a lower portion thereof, e.g. at about one-third the distance from the bottom thereof. Projection 20 forms the upper boundary of a chamber 21 lying therebelow. As a result of the constriction in the cooling container 3 caused by projection 20, the lower part of the coal bed 11 necessarily and inherently will have a free lower obliquely extending bank-like surface 13 which also partially defines the chamber 21. The lower region, i.e. that region below the projection 20, of the inside of the cooling container 3 is lined with a fireproof rammed lining 32. The bottom of the coal bed 11 rests on that portion of the lining 32 covering a slag bath tank 22 formed by the coolant lines of the lower part of the cooling container 3. The bank forming the free lower surface 13 of the coal bed 11 is spaced from an overspill or overlow weir 16 formed at that end of the slag bath tank 22 which faces away from the coal bed 11. As may be seen particularly from FIG. 3, the weir 16 is generally V-shaped.

When the shaft gasifier is in operation the liquid slag, formed during the gasification operation, will collect as a slag bath 14 having a free surface extending between the free lower surface 13 and the weir 16. The free surface of the slag bath 14 defines the base of the chamber 21, except for a steam opening 24, to be explained in more detail below. The outer part of the chamber 21 is defined by the rammed lining of the cooling container 3.

Directly opposite the overspill weir 16 a burner 2 is arranged in the wall of the pressure container 1. Powdered coal, oxygen or oxygen-containing gas, and if necessary additional steam, are supplied to burner 2. A primary gas jet 15 formed by the burner 2 is directed obliquely downwardly in the direction of the free lower surface 13 and the free surface of the slag bath 14. In this way there is achieved an intensive gasification of the coal of the lower free surface 13 and also of any of the coal lumps which may be floating on the slag bath 14. The weir 16 is prevented from becoming blocked, since the primary gas jet 15 is directed counter to the direction of the slag flow flowing toward the weir 16.

The liquid slag flowing over the weir 16 forms a downward falling stream of slag 17 in the steam opening 24. A jet of pressure water 18 issuing from a water jet projector 23 arranged in the wall of the pressure container 1 is directed against the free falling stream of slag 17. In this way the liquid slag is finely atomized and cooled. At the same time steam is produced which passes upwardly through steam opening 24 into chamber 21 and which is then carried along by the jet of primary gas 15 as process steam through the chamber 21 and against and into the free lower surface 13 of the coal bed 11 together with the primary gas. Both the primary gas jet 15 and also the pressure water jet 18 may be regulated in order to control and influence the course and details of the gasification operation or to provide suitable quantities of quenching water for the quenching of the process. Surplus steam can be drawn off via a steam outlet 25.

The atomized and at least partly cooled slag drops into a water bath 19 arranged below the slag bath tank 22 in the pressure container 1, for final granulation, along with the nonevaporated cooling water of the pressure water jet 18. The mixture of granulated slag and cooling water may be discharged from water bath 19 via a discharge valve 26. A condensed water outlet 27 for discharging water vapor condensed in the pressure container 1 during operation is located in the pressure container 1 at the lowest point thereof adjacent to the discharge valve 26.

The lumps of coal from the bed 11 are supplied in the direction of the free lower surface 13 by two obliquely downwardly extending stirrer devices 9 and 10 having conveyor screws and through which coolant also flows. At the upper part of the pressure container 1 there is a similarly cooled gas outlet 6 for the product gas of the gasification operation of the invention. The coolant lines of the gas outlet 6 may be supplied separately, but they may also be connected with the cooling water lines of the cooling container 3.

Figure 4:
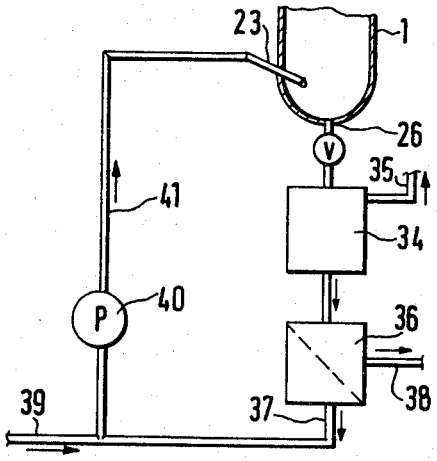
FIG. 4 is a schematic view illustrating the circulation of the cooling water obtained with the method according to the invention.

As shown in FIG. 4, the mixture of granular slag and cooling water passes via the discharge valve 26 to a pressure release vessel 34 having a steam outlet 35, and then to a granular slag filter 36. The granular slag material is discharged via a granular material discharge 38.

The cooling water is discharged through outlet 37 and is led back via a pump 40 and a return line 41 to the water jet nozzle 23. An additional water line 39 upstream of the pump 40 may discharge into the junction between cooling water outlet 37 and return line 41 for the supply of additional water.

The method of the invention allows the gasification of those types of coals which contain a relatively high proportion of fine grains. The heat economy of the method of the invention is particularly favorable, since even the heat contained in the liquid slag is used for the process. The slag is atomized when it is in the fluid state and therefore there are formed small granules of slag which are easy to discharge and to further treat. The method of gasification according to the invention produces no environment polluting waste water and in addition is able to use other extraneous waste water. During the method according to the invention both $CH_4$-poor synthesis gas for the chemical industry and $CH_4$-rich gas to be used as pipeline gas for hydrocarbon synthesis may be manufactured in one and the same reactor. The gasification of the coal bed 11 without clogging and the use of the quenching steam are particular advantages of the method according to the invention.

The method may be carried out at a high gas outlet temperature of for example 1050° C. The product gas would then have a very low proportion of methane. A pressure of 35 bar abs., for example, would prevail in the pressure container 1. Steam at 40 bar abs. would be produced in the coolant pipes of the container, and most of this steam could be used for purification of the gas. Any surplus steam could be discharged to an oxygen plant or used for producing electrical power.

Advantageously, the burner 2 is the type of reaction apparatus with which not only do coal dust, oxygen and if necessary steam or $CO_2$ undergo a thorough mixing and chemical reaction but also with which a preliminary separation of the liquid drops of slag takes place. Cyclone burners of known configuration are particularly well suited for this purpose. The primary gas jet which enters the chamber 21 from the burners 2 is therefore largely free of liquid drops of slag. The separation of the remaining very fine drops of slag takes place when they pass through the coal bed 11 at the lower free surface 13 which is constantly renewed and therefore does not become blocked. The primary gas contains $CO_2$. Before penetrating into the layer of the coal bed, the primary gas is mixed with steam. $CO_2$ and $H_2O$ react with the carbon of the coal bed 11 according to the following equations:

$$C+H_2O=CO+H_2$$

$$C+CO_2=2CO.$$

Since both reactions are endothermic, the primary gas is rapidly cooled. The product gas outlet temperature may be adjusted by adjusting the height of the coal bed 11. The product gas temperature will be between 300° and 1200° C., depending in all cases on the height of the coal bed.

The proportion of methane of the product gas is determined not only by the properties of the coal, but also by the temperature and residence time of the gas in the chamber above the coal bed 11. If, for example, a chemical synthesis a gas with a low proportion of methane is desired, then at a temperature between 950° and 1200° C., the residence time is between three and ten seconds. A methane-rich gas is produced at 250° to 800° C. and with a residence time of between zero and five seconds.

The bed 11 consisting of lumps of coal must not only be of a specific height but must also allow the penetration of the primary gas and the decomposition products which are produced from the lump coal during the gasification operation. Such penetration or throughflow is guaranteed if the average grain size of the lump coal is 10 mm and the smallest grain size is not below 5 mm. The largest pieces of coal should be no greater than 100 mm. In order to avoid problems when charging it is advantageous to limit the size of the pieces of coal to 50 mm.

Although the invention has been described and illustrated with respect to preferred features thereof, it is to be understood that various modifications may be made thereto without departing from the scope of the invention.

What I claim is:

1. In a method for the gasification of coal with oxygen or oxygen-containing gas and water vapor and also if required $CO_2$, said method being of the type in which powdered coal is gasified in at least one burner, e.g. a cyclone burner, with oxygen or oxygen-containing gas and steam and also if required added $CO_2$ and the primary gas thereby produced is passed under pressure upwardly, preferably in a countercurrent direction, through coarser coal contained in a shaft gasifier, e.g. a bed of lumps of coal forming free surfaces on the top and bottom thereof, thereby producing product gas and forming liquid slag, the improvement comprising:

collecting said liquid slag formed in said shaft gasifier in a slag bath within the interior of said shaft gasifier;

allowing the thus collected liquid slag to flow off over a weir into a cooling water bath provided in said shaft gasifier;

directing at least one water jet against said liquid slag at a position located below at least one jet of said primary gas as the slag is falling freely within said shaft gasifier between said weir and said cooling water bath, thus atomizing said liquid slag, thereby cooling said slag and generating steam; and directing said at least one jet of said primary gas toward said coarser coal, to said free bottom surface of said bed thereof, and supplying at least part of said steam generated during the atomization of said slag as process steam to said coarser coal, to said free bottom surface of said bed thereof, by said steam being directly mixed with and carried by said primary gas jet toward said coarser coal.

2. A method as claimed in claim 1, wherein the total mass flow of said at least one water jet is two to ten times as great as the mass flow of said freely falling liquid slag.

3. A method as claimed in claims 1 or 2, wherein said at least one water jet has a velocity of flow of between 20 and 100 meters/second.

4. A method as claimed in claims 1 or 2, further comprising controlling the mass flow and/or velocity of flow of said at least one water jet.

5. A method as claimed in claim 1, further comprising directing said at least one jet of said primary gas onto a free surface of said slag bath.

6. A method as claimed in claim 5, comprising directing said primary gas jet over said weir in a direction counter to the flow of said liquid slag to said weir.

7. A method as claimed in claim 1, further comprising removing a mixture of said cooling water and granular slag from said cooling water bath, filtering and removing said granular slag from said cooling water to form purified cooling water, and recirculating said purified cooling water to be used to form said at least one water jet.

8. A method as claimed in claim 7, further comprising relieving the pressure of said mixture of cooling water and granular slag before the granular slag is filtered and removed therefrom.

9. A method as claimed in claim 1, comprising collecting said liquid slag in a direction laterally of said bottom free surface of said bed of coarser coal within a chamber in said shaft gasifier providing said slag with an upper free surface.

10. A method as claimed in claim 1, comprising collecting said liquid slag in a slag tank within said shaft gasifier to form said slag bath, said weir defining a portion of the walls of said slag tank.

11. A method as claimed in claim 1, wherein said liquid slag falls freely from said weir toward said cooling water tank through a steam opening within said shaft gasifier, and said steam which is supplied to said coarser coal as process steam passes upwardly through said steam opening.

* * * * *